US007331284B2

(12) United States Patent
Takahashi

(10) Patent No.: US 7,331,284 B2
(45) Date of Patent: Feb. 19, 2008

(54) MULTI-DRUM STENCIL PRINTER WITH DUPLEX PRINTING SECTIONS

(75) Inventor: Mituru Takahashi, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 11/362,815

(22) Filed: Feb. 28, 2006

(65) Prior Publication Data

US 2006/0283342 A1 Dec. 21, 2006

(30) Foreign Application Priority Data

Jun. 16, 2005 (JP) ..... 2005-176908

(51) Int. Cl.
*B41L 13/04* (2006.01)

(52) U.S. Cl. ..... 101/118; 101/115; 101/116

(58) Field of Classification Search ..... 101/114, 101/115, 116, 117, 118, 119, 120, 129
See application file for complete search history.

(56) References Cited

U.S. PATENT DOCUMENTS 6,067,902 A 5/2000 Takahashi
6,311,613 B1 11/2001 Takahashi
6,374,730 B1 * 4/2002 Kuratani et al. ..... 101/115
6,718,872 B2 * 4/2004 Kanno ..... 101/118
2003/0127001 A1 7/2003 Kanno ..... 101/116

FOREIGN PATENT DOCUMENTS

JP 10-297074 11/1998
JP 2003-200645 7/2003

* cited by examiner

*Primary Examiner*—Leslie J. Evanisko
(74) *Attorney, Agent, or Firm*—Oblon, Spivak, McClelland, Maier & Neustadt, P.C.

(57) ABSTRACT

A stencil printer includes at least an upstream and a downstream printing section, as seen in the direction of sheet conveyance, each including a print drum and a press roller for pressing a sheet against the print drum. An intermediate conveyor, positioned between the upstream and downstream printing sections, conveys the sheet from the former toward the latter. A dual master, formed with a first and a second image, is wrapped round the print drum of the upstream printing section. This printing section includes a refeeding device, a path selector, and a switching device.

15 Claims, 6 Drawing Sheets

MULTI-DRUM STENCIL PRINTER WITH DUPLEX PRINTING SECTIONS

BACKGROUND OF THE INVENTION

1. Field of the Invention

The present invention relates to a stencil printer of the type including a plurality of print drums and capable of completing multicolor printing in a single flow.

2. Description of the Background Art

A digital, thermosensitive stencil printer is extensively used as a simple, convenient printer and loaded with a stencil made up of a thermoplastic resin film and a porous support adhered together. The stencil printer includes a thermal head having a number of heat generating elements arranged thereon and conveying means, including a platen roller, for conveying the stencil held in contact with the thermal head. The heat generating elements of the thermal head are selectively energized by pulse current in order to selectively perforate, or cut, the thermoplastic resin film of the stencil with heat in accordance with image data. The perforated part of the stencil, i.e., a master is cut off and then wrapped round a porous, hollow print drum. Subsequently, a paper sheet or similar recording medium is pressed against the outer periphery of the print drum with the result that ink is transferred to the paper sheet via the porous portion of the print drum and the perforations of the master, forming an image on the paper sheet.

Today, multicolor printing for producing multicolor prints with the principle of stencil printing stated above is spreading. Japanese patent laid-open publication No. 10-297074, for example, discloses a stencil printer of the type including a plurality of print drums arranged side by side and each storing ink of a particular color. When the print drums are rotated in synchronism with each other by a single drive means, pressing means, corresponding one-to-one to the print drums, sequentially press a sheet against the print drums in order to sequentially transfer the ink of different colors to the sheet one above the other. As a result, a multicolor print is produced by a single flow.

Further, duplex printing for printing images on both sides of a sheet is extensively used for the purpose of reducing sheet consumption and a document storing space. Japanese patent laid-open publication No. 2003-200645, for example, proposes a stencil printer operable in a duplex print mode by using a master in which a first and a second image are cut, or perforated, side by side in the direction of rotation of a print drum. In operation, one of the first and second images is printed on one side of a first sheet fed from a sheet feeding section, and then the first sheet is conveyed to an auxiliary tray. Subsequently, the above image is printed on one surface of a second sheet also fed from the sheet feeding section, and then the second sheet is conveyed to the auxiliary tray. At the same time, the first sheet is again fed from the auxiliary tray in order to have the other image printed on the other surface thereof and is then driven out to a print tray. Such a procedure is repeated to produce duplex prints by a single flow.

Although the prior art stencil printers taught in the documents stated above can execute either one of multicolor printing and duplex printing in a single flow each, they cannot execute duplex multicolor in a single flow.

SUMMARY OF THE INVENTION

It is an object of the present invention to provide a multiple-drum type stencil printer capable of executing duplex multicolor printing in a single flow by using a plurality of print drums.

A multi-drum type stencil printer of the present invention includes a plurality of printing sections each including a respective print drum and a respective press roller member configured to press a sheet against the print drum, and an intermediate conveyor positioned between nearby printing sections for conveying the sheet from upstream one of the nearby printing sections toward downstream one of the same in the direction of sheet conveyance. A dual master, formed with a first and a second image, is wrapped round the print drum included in the most upstream printing section in the direction of sheet conveyance. The press roller included in the most upstream printing section is caused to rotate by a drive source. The most upstream printing section is implemented as a single-flow duplex printing section including a refeeding device configured to store a sheet, carrying an image on one surface thereof, and then refeed the sheet toward a gap between the print drum and the press roller, a path selector selectively movable to a first position for guiding the sheet toward the refeeding device or a second position for guiding it toward the intermediate conveyor, and a switching device for causing the press roller to remain in contact with the print drum over a first range corresponding to the first image, a second range corresponding to the second image or a third range covering both of the first and second images.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
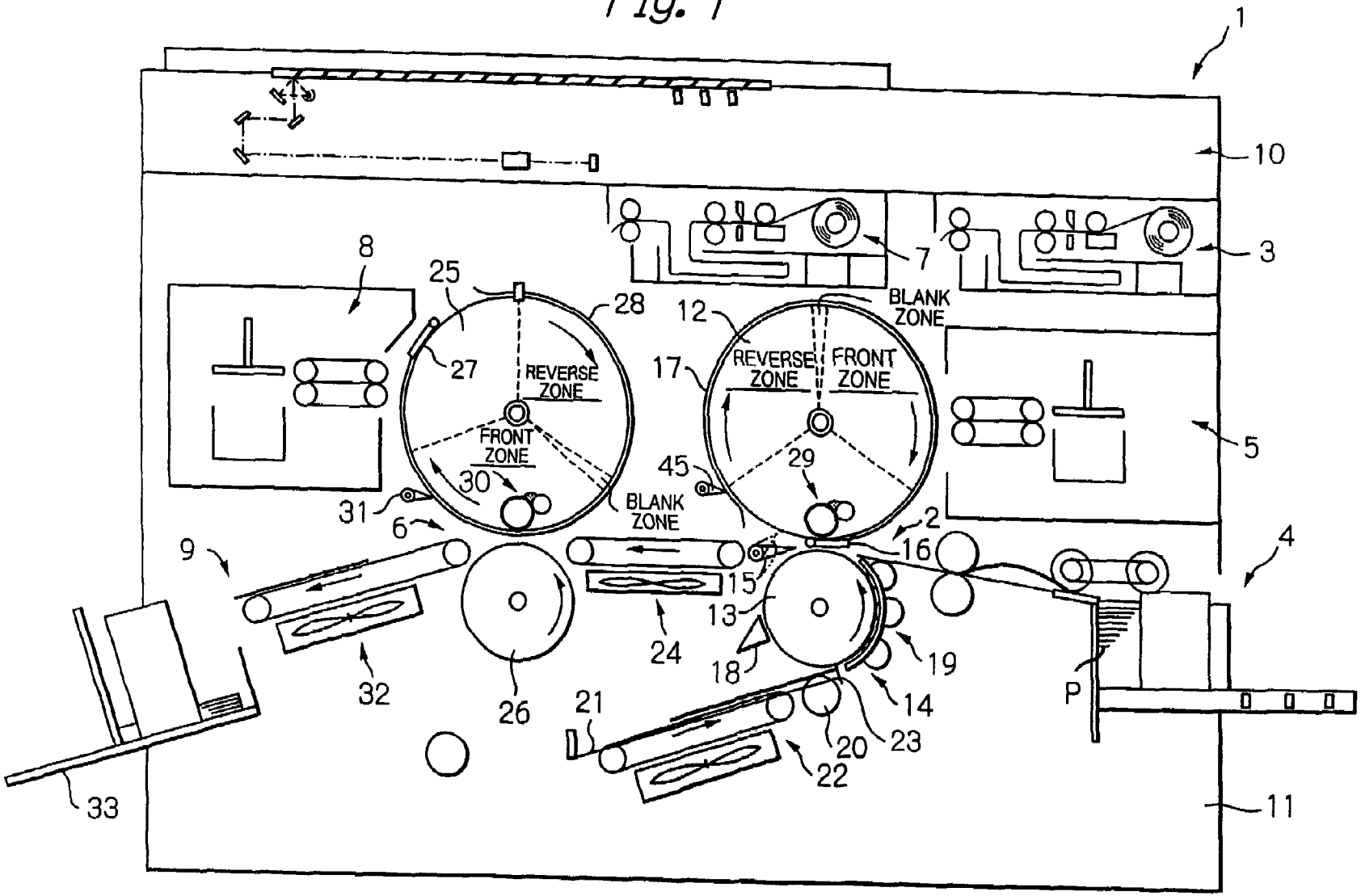
FIG. 1 is a front view showing a stencil printer embodying the present invention.

Referring to FIG. 1 of the drawings, a stencil printer embodying the present invention and including a plurality of print drums is shown and generally designated by the reference numeral 1. It is to be noted that the stencil printer 1 has a construction relating to the stencil printer taught in Japanese patent laid-open publication No. 2003-200645 mentioned earlier, and therefore the structural parts and elements thereof will be described as briefly as possible.

As shown in FIG. 1, the stencil printer 1 includes a single-flow or upstream duplex printing section 2, a master making section 3, a sheet feeding section 4, a master discharging section 5, a downstream printing section 6, a master making section 7, a master discharging section 8, an intermediate conveyor 24, a sheet or print discharging section 9, an image reading section or image scanner 10 and a printer body or frame 11.

The single-flow duplex printing section 2, located at substantially the center of the printer body 11, includes a print drum 12, a press roller or pressing member 13, a refeeding device or refeeding means 14 and a path selector 15. The print drum 12 is rotatably, removably mounted on the printer body 11 and caused to rotate by a drive source or drum drive means not shown. A clamper 16 is hinged to the outer circumference of the print drum 12 in such a manner as to be openable away from the print drum 12.

A dual master 17 is formed by the master making section 3 and then wrapped round the print drum 12. A first or front-surface image and a second or reverse-surface image are cut in the dual master 17 side by side with a blank or non-cut portion intervening therebetween. More specifically, the dual master 17 is wrapped round the print drum 12 such that the first and second images thereof are positioned on a front zone and a reverse zone, respectively, formed on the print drum 12 while the blank portion between them is positioned on a blank zone also formed on the print drum 12, as shown in FIG. 1. A rotary encoder, not shown, is positioned in the vicinity of the outer circumference of the print drum 12 for sensing the angular position of the print drum 12.

A conventional ink feeding device or ink feeding means, generally 29, is arranged in the print drum 12 and includes an ink roller, a doctor roller, an ink feed pipe, an ink pack, not shown, storing black ink and an ink feed pump not shown. The ink feeding device 29 is mounted to or dismounted from the printer body 11 integrally with the print drum 12.

The press roller 13 is positioned below the print drum 12 and formed of fluorocarbon resin or similar water-repulsive elastic material. The press roller 13 is rotably supported at opposite ends thereof by a pair of arm members, not shown, which are, in turn, angularly movably supported by moving means 34, see FIG. 3. In this configuration, the press roller 13 is movable between a released position where it is released from the print drum 12, as shown in FIG. 1, and a contact position where it is pressed against the dual master 17 wrapped round the print drum 12. A guide member 18 is positioned in the vicinity of the circumferential surface of the press roller 13 in order to guide a sheet P, carrying an image on one side or front surface thereof, to the auxiliary tray 21.

Press roller drive means, not shown, identical in configuration with press roller drive means 139 taught in Japanese patent laid-open publication No. 2003-200645 mentioned earlier, is located in the vicinity of the press roller 13 and causes the press roller 13 to rotate at the same peripheral speed as the print drum 12. A one-way clutch, not shown, is mounted on the press roller drive means in order to cause the press roller 13 to follow the rotation of the print drum 12 when pressed against the print drum 12.

The moving means 34 for angularly moving the arm members, not shown, includes three cam plates like a press roller moving mechanism 55 also taught in the above laid-open publication No. 2003-200645. The three cam plates are selectively brought into contact with a cam follower mounted on the arm members in order to cause the press roller 13 to selectively remain contact with the print drum 12 over a first range corresponding to the first image or front zone, a second range corresponding to the second image or reverse zone or a third range including both of the first and second images or front and reverse zones. In this sense, the moving means 34 plays the role of switching means for switching the range over which the press roller 13 is to be continuously pressed against the print drum 12. Press roller holding means, not shown, is located in the vicinity of the moving means 34 for holding the press roller 13 at the released position.

A refeed guide member 19 is positioned at the right-hand side of the press roller 13 and configured to convey the sheet P, carrying an image on the front surface thereof and refed from the auxiliary tray 21, along the circumferential surface of the press roller 13. A refeed registration roller 20 is positioned below the press roller 13 in order to pay out the sheet P from the auxiliary tray 21 while holding it in contact with the circumferential surface of the press roller 13. Refeed conveying means 22, having the auxiliary tray 21 on the top thereof, is located at the lower left of the press roller 13. A refeed positioning member 23 is constructed integrally with the refeed conveying member 22. The refeed guide member 19, refeed registration roller 20, auxiliary tray 21, refeed conveying member 22 and refeed positioning member 23 constitute the refeeding device or means 14 in combination.

The path selector 15 is positioned on a sheet path at the left-hand side of the position where the print drum 12 and press roller 13 are expected to contact each other. The path selector 15 is angularly movably supported by the printer body 11 at its downstream end in the direction of sheet conveyance and selectively moved by moving means, not shown, to a first position indicated by a dash-and-dots line in FIG. 1 or a second position indicated by a solid line in FIG. 1. The path selector 15 guides the sheet P passed through the nip between the print drum 12 and the press roller 13 toward the auxiliary tray 21 when held in the first position or guides it toward the intermediate conveyor 24 when held in the second position.

The master making section 3 is arranged at the upper right of the single-flow duplex printing section 2 and has a conventional configuration including a stencil holder holding a stencil roll, a platen roller, a thermal head, stencil cutting means, a stencil stocking portion, a tension roller pair and a reverse roller pair. With this configuration, the master making section 3 perforates, or cuts, a stencil paid out from the stencil roll for thereby producing the dual master 17.

The sheet feeding section 4 is positioned at the lower right of the single-flow duplex printing section 2 and pays out the top sheet P toward the printing section 2 at preselected timing while separating it from the underlying sheets. The sheet feeding section 4 has a conventional construction including a sheet tray loaded with a stack of sheets P, a pickup roller, a reverse roller or separating roller and a registration roller pair.

The master discharging section 5 is located at the right-hand side of the single-flow duplex printing section 2 between the master making section 3 and the sheet feeding section 4 and configured to peel off a used dual master 17 from the circumferential surface of the print drum 12 and discard it. More specifically, the master discharging section 5 has a conventional construction including an upper and a lower master discharging member, a used master box and a compressing plate. The used dual master 17, peeled off from the print drum 12, is conveyed to the used mater box and then compressed by the compressing plate.

The printing section 6 is located at the left-hand side of the single-flow duplex printing section 2 and includes a print drum 25 and a press roller or pressing member 26. The print drum 12 is rotatably, removably mounted on the printer body 11 and caused to rotate by the previously mentioned drum drive means via drive transmitting means, not shown, in synchronism with the print drum 12. A clamper 27 is hinged to the outer circumference of the print drum 25 in such a manner as to be operable away from the print drum 25. A dual master 28 is wrapped round the print drum 25 such that a first and a second image performed therein are positioned in a front zone and a reverse zone, respectively, formed on the print drum 25 while a blank portion, intervening between the front and reverse zones, is positioned on a blank zone also formed on the print drum 25, as shown in FIG. 1. A rotary encoder, not shown, is positioned in the vicinity of the outer circumference of the print drum 25 for sensing the angular position of the print drum 25.

An ink feeding device or ink feeding means 30, identical in configuration with the ink feeding device 29, is disposed in the print drum 25 and removable from the printer body 11 integrally with the print drum 25. An ink pack, not shown, included in the ink feeding device 30 stores ink different in color from the ink stored in the ink pack of the ink feeding device 29. In the illustrative embodiment, the ink pack of the ink feeding device 29 and the ink pack of the ink feeding device 30 store black ink and red ink, respectively, by way of example.

The press roller 26, identical in configuration with the press roller 13, is positioned below the print drum 25 and rotatably supported at opposite ends thereof by a pair of arm members, not shown, which are, in turn, angularly movably supported by moving means 35, see FIG. 3. In this configuration, the press roller 26 is movable between a released position where it is released from the print drum 25, as shown in FIG. 1, and a contact position where it is pressed against the dual master 28 wrapped round the print drum 25.

The moving means 35, like the moving means 34 assigned to the press roller 13, is constructed such that cam plates are selectively brought into contact with a cam follower mounted on the arm members in order to cause press the press roller 26 against the print drum 25 over a first range corresponding to the first image or front zone, a second range corresponding to the second image or reverse zone or a third range including both of the first and second images or front and reverse zones. In this sense, the moving means 35 plays the role of switching means for switching the range over which the press roller 26 is to be pressed against the print drum 25. Press roller holding means, not shown, is located in the vicinity of the moving means 35 for holding the press roller 26 at the released position.

The master making section 7 is arranged at the upper right of the printing section 6 and has a conventional configuration including a stencil holder holding a stencil roll, a platen roller, a thermal head, stencil cutting means, a stencil stocking portion, a tension roller pair and a reverse roller pair like the master making section 3. With this configuration, the master making section 7 produces the dual master 28.

The master discharging section 8 is located at the right-hand side of the printing section 6 and configured to peel off a used dual master 28 from the circumferential surface of the print drum 25 and discard it. More specifically, the master discharging section 8, like the master discharging section 5, has a conventional construction including an upper and a lower master discharging member, a used master box and a compressing plate. The used dual master 28, peeled off from the print drum 25, is conveyed to the used mater box and then compressed by the compressing plate.

The intermediate conveyor 24, positioned between the single-flow duplex printing section 2 and the printing section 6, is implemented as a suction type conveyor including a drive roller, a driven roller, an endless belt passed over the drive roller and driven roller and a suction fan. The sheet P, coming out of the single-flow duplex printing section 2, is retained on the endless belt by the suction fan and then conveyed by the belt toward a gap between the print drum 25 and the press roller 26 at preselected timing. The intermediate conveyor 24 conveys the sheet P at such a speed that an image printed on the sheet P by the single-flow duplex printing section 2 is accurately superposed on an image printed by the printing section 6.

A peeler 45 is positioned at the upper right of the intermediate conveyor 24 in order to peel off the sheet P printed carrying an image thereon from the surface of the print drum 12. More specifically, the peeler 45 is angularly movably supported by the printer body 11 at one end and caused to move by moving means, not shown, such that its sharp edge is selectively moved toward or away from the surface of the print drum 12.

The sheet discharging section 9 is arranged below the master discharging section 8 and includes a peeler 31, sheet conveying means 32 and a print tray 33. The peeler 31, configured to peel the sheet P printed with an image from the surface of the print drum 25, is movably supported by the printer body 11 at one end and caused to move by moving means, not shown, such that its sharp edge is selectively moved toward or away from the surface of the print drum 25. The sheet conveying means 32 is implemented as a suction type conveyor including a drive roller, a driven roller, an endless belt passed over the drive roller and driven roller and a suction fan. The sheet P, coming out of the printing section 6, is retained on the belt by the suction fan and conveyed toward the print tray 33 by the belt. The print tray 33 includes a single end fence and a pair of side fences for positioning consecutive prints P sequentially stacked on the print tray 33.

The image reading section or image scanner 10 is located in the upper portion of the printer body 11 and has a conventional construction including a glass platen on which a document is to be laid, a cover plate movable toward and away from the glass platen, a scanning unit for reading the image of the document, a lens for converging the resulting imagewise light, and an image sensor for processing the image thus focused thereon.

Figure 2:
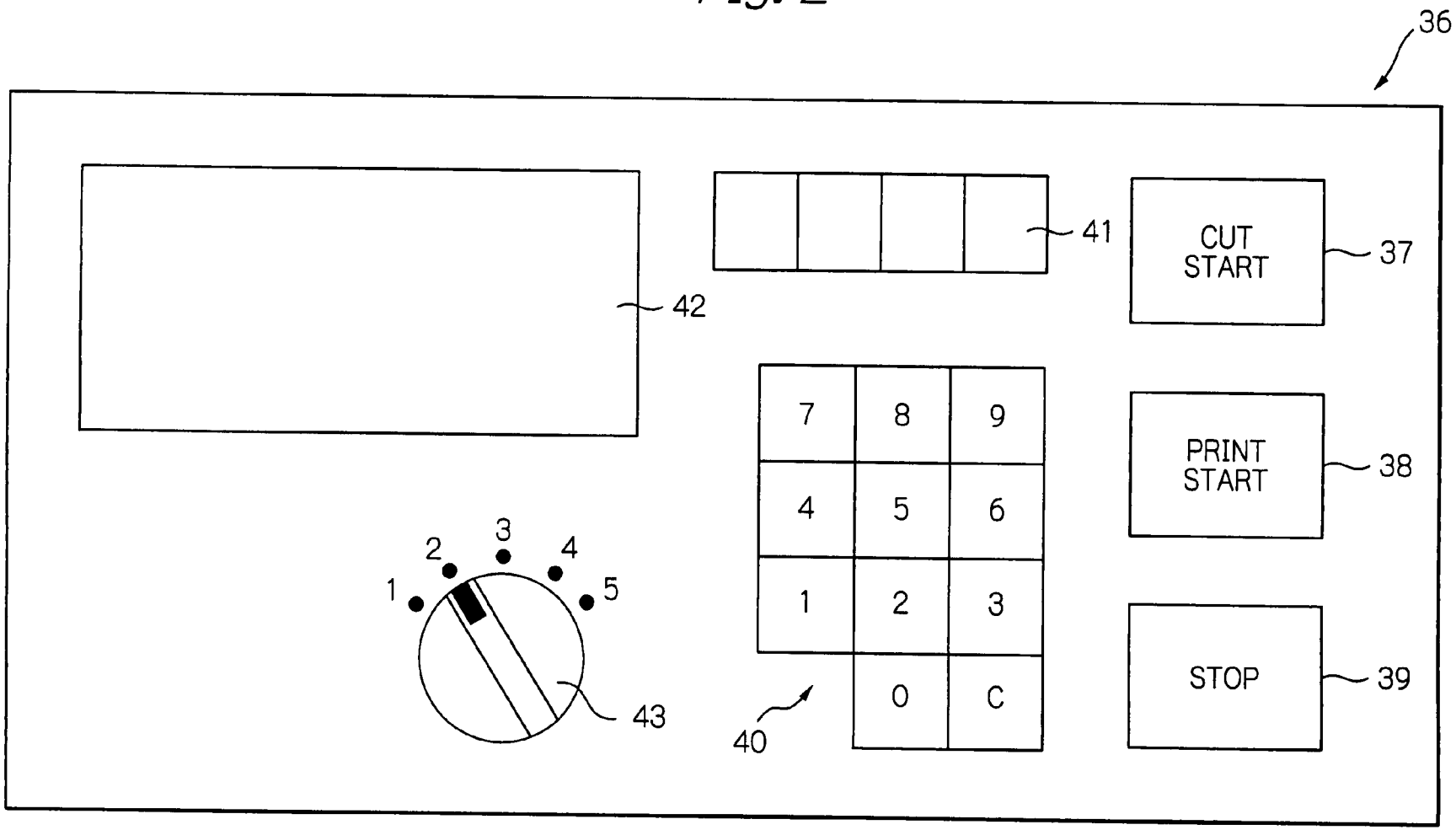
FIG. 2 shows a specific configuration of a control panel mounted on the stencil printer of FIG. 1.

FIG. 2 shows a specific configuration of a control panel mounted on the top front portion of the printer body 11. As shown, the control panel, generally 36, has a conventional configuration including a cut or perforation start key 37, a print start key 38, a stop key 39, a numeric keypad 40, a display 41 implemented by seven-segment LEDs (Light Emitting Diodes) and a display 42 implemented by an LCD (Liquid Crystal Display) panel. In the illustrative embodiment, the control panel 36 further includes a select switch 43 for allowing the operator of the stencil printer 1 to select desired one of a first print mode for producing a print carrying a monochromatic image on one surface thereof (simplex monochrome mode), a second print mode for producing a print carrying a multicolor image on one surface thereof (simplex multicolor print mode), a third print mode for producing a print carrying images of the same color on opposite surface thereof (duplex same-color print mode), a fourth print mode for producing a print carrying images of different colors on opposite surfaces thereof (duplex different-color print mode) and a fifth print mode for producing a print carrying a monochromatic image on one surface thereof and carrying a multicolor image on the other surface thereof (one-surface monochrome, the other-surface multicolor print mode), as will be described more specifically later.

Figure 3:
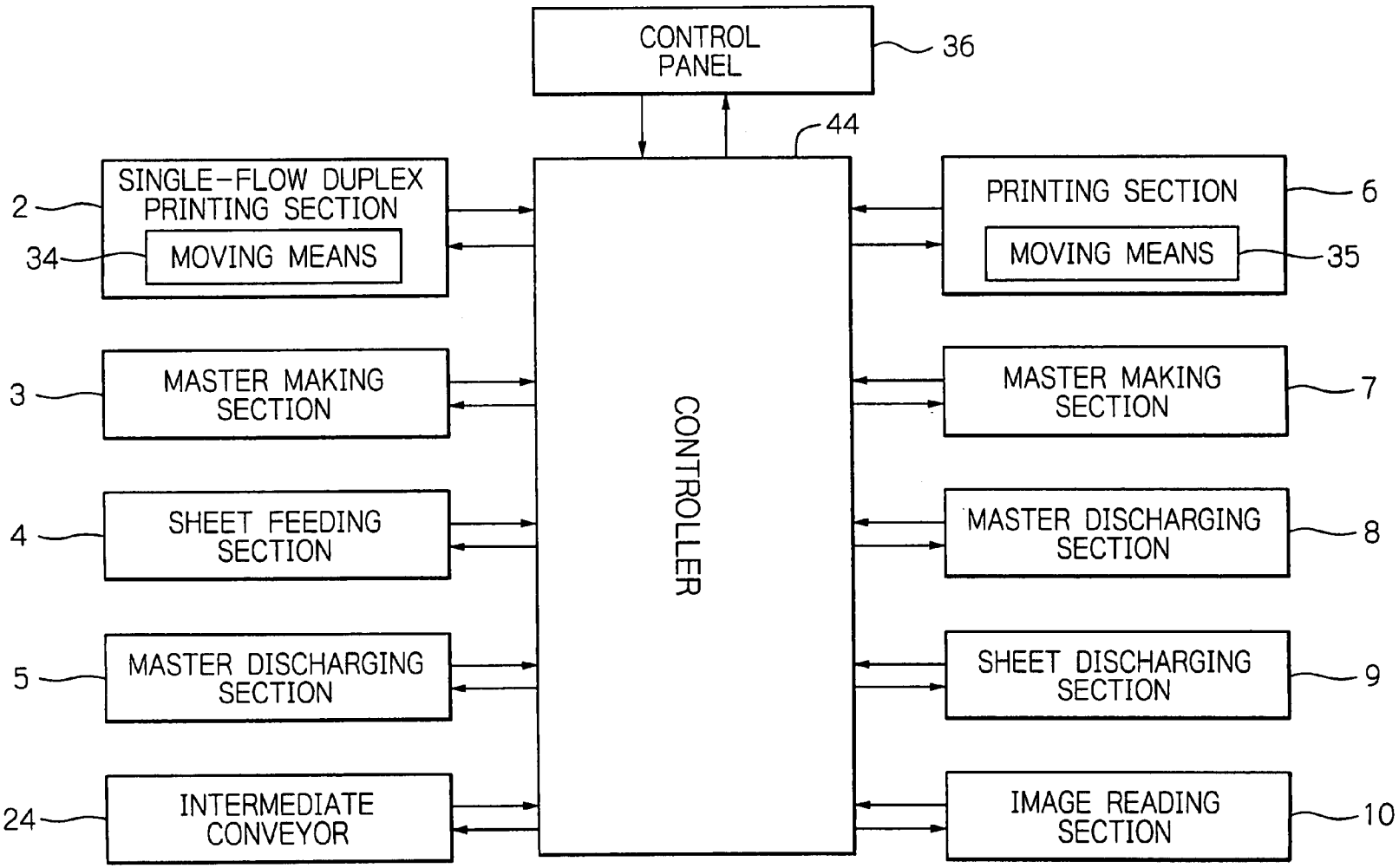
FIG. 3 is a block diagram schematically showing a control system included in the illustrative embodiment.

FIG. 3 shows a control system included in the illustrative embodiment. As shown, the control system includes a controller or control means 44 implemented as a conventional microcomputer including a CPU (Central Processing Unit), a ROM (Read Only Memory) and a RAM (Random Access Memory), although not shown specifically. The controller 44 controls the single-flow duplex printing section 2, master making section 3, sheet feeding section 4, master discharging section 5, printing section 6, master making section 8, master discharging section 10 and intermediate conveyor 24 in accordance with the output signals of the rotary encoders and control panel 36 as well as signals output from various sensors, not shown, also arranged in the stencil printer 1.

A specific operation of the stencil printer 1 will be descried hereinafter. First, assume that the operator of the stencil printer 1 selects the first or simplex monochrome print mode by setting the select switch 43 at the position of "1" on the control panel 36.

When the operator sets a single document on the glass platen of the image reading section 10 and then pushes the cut start key 37, the image reading section 10 starts reading the image of the document while the master discharging section 5 starts peeling the used dual master 17 from the circumferential surface of the print drum 12. After the used master 17 has been discarded, the master making section 3 produces a new dual master 17. The new dual master 17 is then wrapped round the print drum 12.

In the simplex monochrome print mode selected, only a first image is perforated in the stencil because a single document is used, so that the dual master 17 is produced as if it were a conventional master. Also, in this mode operation, the printing section 6 is not used, and neither the removal of the used dual master 28 from the print drum 25 nor the production of a new dual mater 28 is executed. During printing, the press roller 26 is not moved, but held in the released position by the press roller holding means mentioned earlier. The path selector 15 is held in the second position in this mode.

After the stencil printer 1 has been brought into a stand-by condition with the new dual master 17 wrapped round the print drum 12, the operator pushes the print start key 38. In response, the print drum 12 starts being rotated at a peripheral speed matching with a preselected print speed while the sheet feeding section 4 feeds a single sheet P toward the registration roller pair. The registration roller pair stops the sheet P in order to correct skew thereof and then conveys it toward the gap between the print drum 12 and the press roller 13. It is to be noted that various printing conditions may be input on the control panel 36 before the operator pushes the cut start key 37.

When the print drum 12 is rotated to a preselected angular position where its front zone faces the press roller 13, the press roller 13 is brought to the contact position by the moving means 34 so as to press the sheet P against the first image of the master 17 wrapped round the print drum 12. As a result, an image, corresponding to the image of the document, is formed on the sheet P. At this instant, the moving means 34 is so set as to press the press roller 13 over the first range or the third range of the print drum 12 beforehand. The sheet or simplex print P, coming out of the printing section 2 is peeled off from the drum 12 by the peeler 45 and driven toward the intermediate conveyor 24.

The print P is conveyed by the intermediate conveyor 24 toward the downstream side while being retained on the conveyor 24 by suction. The print P is then handed over to the sheet conveying means 32 via the gap between the print drum 25 and the press roller 26, which is held in the released position then. The print P is further conveyed downward by the sheet conveying means 32 while being retained thereon by suction and then driven out of the printer body 11 to the print tray 33. The procedure described above is repeated until a desired number of simplex monochromatic prints have been output.

While the above procedure is assumed to form only the first image of the dual master 17 on a sheet P, only the second image of the dual master 17 may be formed on a sheet P, in which case the moving means is so set as to press the press roller 13 against the print drum 12 over the second range or the third range beforehand.

Next, assume that the operator selects the second or simplex multicolor print mode by setting the select switch 43 at the position of "2" on the control panel 36. When the operator, selected the second mode, lays first one of two desired documents on the glass platen of the image reading section 10 and then pushes the cut start key 37, the image reading section 10 reads the image of the above document while the master discharging section 5 peels off a used dual master 17 from the print drum 12. After the image reading section 10 has read the entire document, a message, urging the operator to lay the other or second document on the glass platen, appears on the display 42. The operator, watching the message, lays the second document on the glass platen and again presses the cut start key 37. In response, the image reading section 10 reads the image of the second document while the master discharging section 8 peels off a used dual master 28 from the print drum 25. Thereafter, the master making sections 3 and 7 are operated to produce new dual masters 17 and 28, respectively. The new masters 17 and 28 are then wrapped round the print drums 12 and 25, respectively.

In the simplex multicolor print mode, only the first image is cut in each of the dual masters 17 and 28 thus produced without the second image being cut therein. Stated another way, the dual masters 17 and 28 are produced as if they were a conventional master each. More specifically, the master 17 is formed with an image corresponding to the image of the first document of the first color (black in the illustrative embodiment) while the master 28 is formed with an image corresponding to the image of the second document of the second color (red in the illustrative embodiment). During this mode operation, the path selector 15 is held in the second position.

After the stencil printer 1 has been brought into a stand-by condition with the dual masters 17 and 28 being wrapped round the print drums 12 and 25, respectively, the operator inputs desired printing conditions on the control panel 36 and then pushes the print start key 38. In response, the print drums 12 and 25 are caused to rotate at a peripheral speed corresponding to a desired print speed while a single sheet P is fed from the sheet feeding section 4 toward the registration roller pair. The registration roller pair stops the sheet P to correct skew thereof and then drives it toward the gap between the print drum 12 and the press roller 13 at preselected timing.

When the print drum 12 is rotated to a preselected angular position where its front zone faces the press roller 13, the press roller 13 is brought to the contact position by the moving means 34 so as to press the sheet P against the first image of the master 17 wrapped round the print drum 12. As a result, an image, corresponding to the image of the first document, is formed on the sheet P. At this instant, the moving means 34 is so set as to press the press roller 13 over the first range or the third range of the print drum 12 beforehand. The sheet P, thus formed with a black image and coming out of the printing section 2, is peeled off from the drum 12 by the peeler 45 and driven toward the intermediate conveyor 24.

Subsequently, the sheet P is conveyed by the intermediate conveyor 24 toward the downstream side while being retained on the conveyor 24 by suction and brought to the gap between the print drum 25 and the press roller 26 at preselected timing. When the print drum 25 is rotated to a preselected angular position where its front zone faces the press roller 26, the moving means 35 moves the press roller 26 to the contact position and causes it to press the sheet P against the first image of the dual master 28 present on the print drum 25. As a result, a red image, corresponding to the image of the second document, is transferred to the upper surface of the sheet P, completing a simplex multicolor print. At this instant, the moving means 35 is so set as to press the press roller 26 against the print drum 25 over the first range or the third range beforehand.

The simplex multicolor print P thus produced is peeled off from the print drum 25 by the peeler 31, which is positioned close to the print drum 25 then, and transferred to the sheet conveying means 32. The print P is then conveyed further downward by the sheet conveying means 32 while being retained thereon by suction and driven out to the print tray 33. The procedure described above is repeated until a desired number of prints have been output.

While the above simplex multicolor procedure is assumed to form only the first images in the dual masters 17 and 28 without forming the second images, either one of the first and second images may be formed in each of the masters 17 and 28 without the other image being formed. In such a case, the moving means 34 and 35 are so set as to press the press rollers 13 and 26, respectively, to contact the print drums 12 and 25, respectively, over the first range or the third range when the first image is formed or over the second range or the third range when the second image is formed.

Assume that the operator selects the third or duplex same-color print mode by setting the select switch 43 at the position of "3" on the control panel 36. When the operator, selected the third mode, lays first one of two desired documents on the glass platen of the image reading section 10 and then pushes the cut start key 37, the image reading section 10 reads the image of the above document while the master discharging section 5 peels off a used dual master 17 from the print drum 12. After the image reading section 10 has read the entire document, the operator lays the second document on the glass platen and again presses the cut start key 37. In response, the image reading section 10 reads the image of the second document while the master discharging section 8 peels off a used dual master 28 from the print drum 25. Thereafter, the master making section 3 is operated to produce a new dual master 17. The new master 17 is then wrapped round the print drum 12.

In the duplex same-color print mode, the first and second images, respectively corresponding to the first and second documents, are formed in the dual master 17 side by side. Also, because the duplex print mode under way is of a single color, the printing section 6 is not used, i.e., the separation of the used dual master 28 from the print drum 25 or the production of the new dual master 28 is not executed. Further, the press roller 26 is held in the released position by the press roller holding means not shown.

After the stencil printer 1 has been brought into a stand-by condition with the dual master 17 being wrapped round the print drum 12, the operator inputs desired printing conditions on the control panel 36 and then pushes the print start key 38. In response, the print drum 12 is caused to rotate at a peripheral speed corresponding to a desired print speed while a single sheet P is fed from the sheet feeding section 4 toward the registration roller pair. The registration roller pair stops the sheet P to correct skew thereof and then drives it toward the gap between the print drum 12 and the press roller 13 at preselected timing.

The moving means 34 causes the press the press roller 13 to remain in contact with the print drum 12 over the first range. When the print drum 12 is rotated to a preselected angular position where its front zone faces the press roller 13, the moving means 34 brings the press roller 13 to the contact position to thereby press the sheet P against the first image formed in the dual master 17. Consequently, an image, corresponding to the image of the first document, is printed on one or front surface of the sheet P. The sheet or simplex print, carrying the above image on the front surface, is peeled off from the print drum 12 by the edge of the path selector 15, which is held in the first position then, and guided to the auxiliary tray 21 thereby. The sheet P on the auxiliary tray 21 is conveyed by the refeed conveying means 22 in a direction indicated by an arrow in FIG. 1 until the leading edge of the sheet P has been stopped by the refeed positioning member 23.

The print drum 12 is continuously rotated even when the first sheet P is being guided to the auxiliary tray 21, while a second sheet P is fed from the sheet feeding section 4 at the same timing as the first sheet P. The second sheet P, like the first sheet P, is pressed against the print drum 12 by the press roller 13 to be formed with a front image on one surface thereof, then peeled off from the print drum 12 by the peeler 15 held in the first position, and then guided to the auxiliary tray 21. At this time, the moving means 34 is so set as to cause the press roller 13 to remain in contact with the print drum 12 over the third range beforehand.

After the second sheet P has been fed from the sheet feeding section 4, but slightly before the time when the reverse zone of the print drum 12 comes to face the press roller 13, the refeed registration roller 20 is driven to press the first sheet P held on the auxiliary tray 21 against the press roller 13. As a result, the first sheet P is conveyed by the press roller 13, which is being driven by the print drum 12 in contact therewith, to the nip between the press roller 13 and the print drum 12 and pressed against the second image formed in the dual master 17, so that an image, corresponding to the image of the second document, is transferred to the reverse surface of the sheet P.

The first sheet or duplex print P, thus carrying the images on both surfaces thereof, is peeled off from the print drum 12 by the path selector 15 held in the second position and the peeler 45 caused to adjoin the print drum 12 and delivered to the intermediate conveyor 24. The duplex print P is then conveyed further downward by the intermediate conveyor 24 to the sheet conveying means 32 via the gap between the press roller 26 and print drum 25 spaced from each other. Finally, the duplex print P is driven out to the print tray 33 by the sheet conveying means 32. The procedure described above is repeated until a desired number of duplex prints have been output. It is to be noted that after the last sheet P has been stopped on the auxiliary tray 21, the moving means 34 causes the press roller 13 to contact the print drum 12 over the second range.

Assume that the operator selects the fourth or duplex different-color print mode by setting the select switch 43 at the position of "4" on the control panel 36. When the operator, selected the fourth mode, lays first one of two desired documents on the glass platen of the image reading section 10 and then pushes the cut start key 37, the image reading section 10 reads the image of the above document while the master discharging section 5 peels off a used dual master 17 from the print drum 12. After the image reading section 10 has read the entire document, the operator lays the second document on the glass platen and again presses the cut start key 37. In response, the image reading section 10 reads the image of the second document while the master discharging section 8 peels off a used dual master 28 from the print drum 25. Thereafter, the master making sections 3 and 7 are operated to produce new dual masters 17 and 28, respectively. The new masters 17 and 28 are then wrapped round the print drums 12 and 25, respectively.

In the duplex different-color print mode, only the first image, corresponding to the image of the first document, is formed in the dual master 17. Likewise, only the first image, corresponding to the image of the second document is formed in the dual master 28.

After the stencil printer 1 has been brought into a stand-by condition with the dual masters 17 and 28 being wrapped round the print drums 12 and 25, respectively, the operator inputs desired printing conditions on the control panel 36 and then pushes the print start key 38. In response, the print drums 12 and 25 are caused to rotate at a peripheral speed corresponding to a desired print speed while a single sheet P is fed from the sheet feeding section 4 toward the registration roller pair. The registration roller pair stops the sheet P to correct skew thereof and then drives it toward the gap between the print drum 12 and the press roller 13 at preselected timing.

The moving means 34 causes the press roller 13 to remain in contact with the print drum 12 over the first range or the third range. When the print drum 12 is rotated to a preselected angular position where its front zone faces the press roller 13, the moving means 34 brings the press roller 13 to the contact position to thereby press the sheet P against the first image formed in the dual master 17. Consequently, an image, corresponding to the image of the first document, is printed in black on one or front surface of the sheet P. The sheet or simplex print, carrying the black image on the front surface, is peeled off from the print drum 12 by the edge of the path selector 15, which is held in the first position then, and guided to the auxiliary tray 21 thereby. The sheet P on the auxiliary tray 21 is conveyed by the refeed conveying means 22 until the leading edge of the sheet P has been stopped by the refeed positioning member 23.

The print drum 12 is continuously rotated even when the first sheet P is being guided to the auxiliary tray 21, while a second sheet P is fed from the sheet feeding section 4 at the same timing as the first sheet P. The second sheet P, like the first sheet P, is pressed by the press roller 13 to be formed with a black image on one surface thereof, then peeled off from the print drum 12 by the peeler 15 held in the first position, and then guided to the auxiliary tray 21.

After the second sheet P has been fed from the sheet feeding section 4, but slightly before the time when the reverse zone of the print drum 12 comes to face the press roller 13, the refeed registration roller 20 is driven to press the first sheet P held on the auxiliary tray 21 against the press roller 13. As a result, if the press roller 13 is expected to contact the print drum 12 over the first range, the first sheet P pressed against the press roller 13 is conveyed by the press roller 13, which is being driven by the press roller drive means while being released from the print drum 12, toward the gap between the press roller 13 and the print drum 12 and then guided to the intermediate conveyor 24 by the path selector 15 held in the second position. On the other hand, if the press roller 13 is expected to contact the print drum 12 over the third range, the first sheet P is conveyed toward the nip between the press roller 13 being rotated by the print drum 12 in contact therewith and the print drum 12 by the press roller 13 and then guided to the intermediate conveyor 24 by the path selector 15 held in the second position.

The sheet or simplex print P, carrying a black image thereon, is conveyed to the downstream side by the intermediate conveyor 24 while being retained thereon by suction such that the sheet P reaches the gap between the print drum 25 and the press roller 26 at preselected timing. In this case, the moving means 35 causes the press roller 26 to contact the print drum 25 over the first range or the third range. When the print drum 25 is rotated to a preselected angular position where its front zone faces the press roller 26, the moving means 35 moves the press roller 26 to the contact position for thereby pressing the sheet P against the first image formed in the dual master 28 wrapped round the print drum 25. Consequently, an image, corresponding to the image of the second document, is printed in red on the reverse surface of the sheet P.

The sheet or different-color duplex print P, thus carrying the black image and red image on opposite surfaces, is peeled off from the print drum 25 by the peeler 31, which is positioned close to the print drum 25 then, and delivered to the sheet conveying means 32. The sheet conveying means 32 conveys the duplex print P further downward to the print tray 33. The procedure described above is repeated until a desired number of duplex prints have been output. It is to be noted that after the last sheet P has been stopped on the auxiliary tray 21, the moving means 34 causes the press roller 13 to contact the print drum 12 over the second range.

While the above duplex different-color procedure is assumed to form the first image to be printed on one surface of the sheet P in the dual master 17 and form the second image to be printed on the other surface of the sheet P in the dual master 28, the first and second images each may be formed in either one of the dual masters 17 and 28. In such a case, when the second image is to be formed in the dual master 17, the moving means 34 is so set as to press the press roller 13 against the print drum 12 over the second range or the third range beforehand while, when the second image is to be formed in the dual master 28, the moving means 35 is so set as to press the press roller 26 against the print drum 25 over the second range or the third range.

Further, assume that the operator selects the fifth or one surface monochrome, the other surface multicolor print mode by setting the select switch 43 at the position of "5" on the control panel 36. When the operator, selected the fifth mode, lays first one of three desired documents on the glass platen of the image reading section 10 and then pushes the cut start key 37, the image reading section 10 reads the image of the above document while the master discharging section 5 peels off a used dual master 17 from the print drum 12. After the image reading section 10 has read the entire document, the operator lays second one of the three documents on the glass platen and again presses the cut start key 37. In response, the image reading section 10 reads the image of the second document. Thereafter, when the operator lays the last document on the glass platen and then pushes the cut start key 37, the image reading section 10 reads the image of the third document while the master discharging section 8 peels off a used dual master 28 from the print drum 25. Subsequently, the master making sections 12 and 25 are operated to produce new dual masters 17 and 28, respectively, and cause the masters 17 and 28 to be wrapped round the print drums 12 and 25, respectively.

In the one surface monochrome, the other surface multicolor print mode, the master 17 is formed with a first image corresponding to the image of the first document and expected to be printed on one surface of the sheet P and the second image corresponding to the image of the second document and expected to be printed on the other surface of the sheet P in a first color. On the other hand, the master 28 is formed with a first image corresponding to the image of the third document and expected to be printed on the other surface of the sheet P in a second color.

After the stencil printer 1 has been brought into a stand-by condition with the dual masters 17 and 28 being wrapped round the print drums 12 and 25, respectively, the operator inputs desired printing conditions on the control panel 36 and then pushes the print start key 38. In response, the print drums 12 and 25 are caused to rotate at a peripheral speed corresponding to a desired print speed while a single sheet P is fed from the sheet feeding section 4 toward the registration roller pair. The registration roller pair stops the sheet P to correct skew thereof and then drives the sheet P toward the gap between the print drum 12 and the press roller 13 at preselected timing.

At this instant, the moving means 34 causes the press roller 13 to remain in contact with the print drum 12 over the first range. When the print drum 12 is rotated to a preselected angular position where its front zone faces the press roller 13, the moving means 34 brings the press roller 13 to the contact position to thereby press the sheet P against the first image formed in the dual master 17. Consequently, an image, corresponding to the image of the first document, is printed in black on one or front surface of the sheet P. The sheet or simplex print P, thus carrying the black image on the front surface thereof, is peeled off from the print drum 12 by the edge of the path selector 15, which is held in the first position then, and guided to the auxiliary tray 21 thereby. The sheet P on the auxiliary tray 21 is conveyed by the refeed conveying means 22 until the leading edge of the sheet P has been stopped by the refeed positioning member 23.

The print drum 12 is continuously rotated even when the first sheet P is being guided to the auxiliary tray 21, while a second sheet P is fed from the sheet feeding section 4 at the same timing as the first sheet P. The second sheet P, like the first sheet P, is pressed by the press roller 13 to be formed with a black image on one surface thereof, then peeled off from the print drum 12 by the peeler 15 held in the first position, and then guided to the auxiliary tray 21. At this instant, the moving means 34 is so set as to press the press roller 13 against the print drum 12 over the third range beforehand.

After the second sheet P has been fed from the sheet feeding section 4, but slightly before the time when the reverse zone of the print drum 12 comes to face the press roller 13, the refeed registration roller 20 is driven to press the first sheet P held on the auxiliary tray 21 against the press roller 13. As a result, the first sheet P is conveyed by the press roller 13, which is being driven by the press roller drive means while being spaced from the print drum 12, to the nip between the press roller 13 and the print drum 12 and pressed against the second image of the dual master 17 thereby. Consequently, an image, corresponding to the image of the second document, is printed in black on the other surface of the first sheet P.

The first sheet or duplex print P, thus carrying black images on both surfaces thereof, is peeled off from the print drum 12 by the path selector 15 held in the second position and peeler 45 positioned close to the print drum 12 and conveyed to the intermediate conveyor 24 thereby. The intermediate conveyor 24 conveys the sheet P to the downstream side while retaining it thereon by suction such that the sheet P reaches the gap between the print drum 25 and the press roller 26 at preselected timing. In this case, the moving means 35 is so set as to press the press roller 26 against the print drum 25 over the first range beforehand. When the print drum 25 is rotated to a preselected angular position where its front zone faces the press roller 26, the moving means 35 moves the press roller 26 to the contact position for thereby pressing the sheet P against the first image formed in the dual master 28 wrapped round the print drum 25. Consequently, an image, corresponding to the image of the third document, is printed in red on the other or reverse surface of the sheet P.

The sheet or one surface monochrome, the other surface multicolor duplex print P, thus carrying the black image and multicolor image on opposite surfaces thereof, is peeled off from the print drum 25 by the peeler 31, which is positioned close to the print drum 25 then, and delivered to the sheet conveying means 32. The sheet conveying means 32 conveys the duplex print P further downward to the print tray 33. The procedure described above is repeated until a desired number of duplex prints have been output. It is to be noted that after the last sheet P has been stopped on the auxiliary tray 21, the moving means 34 causes the press roller 13 to contact the print drum 12 over the second range.

While the above procedure is assumed to form an image, corresponding to the second-color image to be printed on the other surface of the sheet P, as the first image of the dual master 28, an image, corresponding to the second-color image, may be formed in the dual master 28 as the second image, in which case the moving means 35 is so set as to cause the press roller 26 to press against the print drum 25 over the second range or the third range beforehand.

With the configuration described above, the stencil printer 1 allows the operator to select any one of the first or simplex monocolor print mode, second or simplex multicolor print mode, third or duplex monochrome print mode, fourth or duplex multicolor print mode and fifth or one surface monochromoe, the other surface multicolor print mode for thereby executing single-flow duplex multicolor printing.

While the illustrative embodiment includes the single-flow duplex printing section 2 and a single printing section 6 positioned downstream of the printing section 2, a plurality of printing sections identical with the printing section 6 may be arranged side by side in order to implement multicolor printing in three or more different colors. In such an alternative case, an intermediate conveyor identical with the intermediate conveyor 24 is provided between the printing section 6 and the printing section following it and is controlled in the same manner as the printing section 6.

Further, in the illustrative embodiment, the printing section 6 is configured to wrap the dual master 28 round the print drum 25 and form an image in the front zone or the reverse zone of the print drum 25. If desired, the printing section 6 may be replaced with a printing section customarily included in a stencil printer and configured to wrap a master formed with a single image on a print drum, in which case control over the conveying timing of the intermediate conveyor 24 should preferably be varied between the case wherein only the first image is used and the case wherein only the second image is used.

Figure 4:
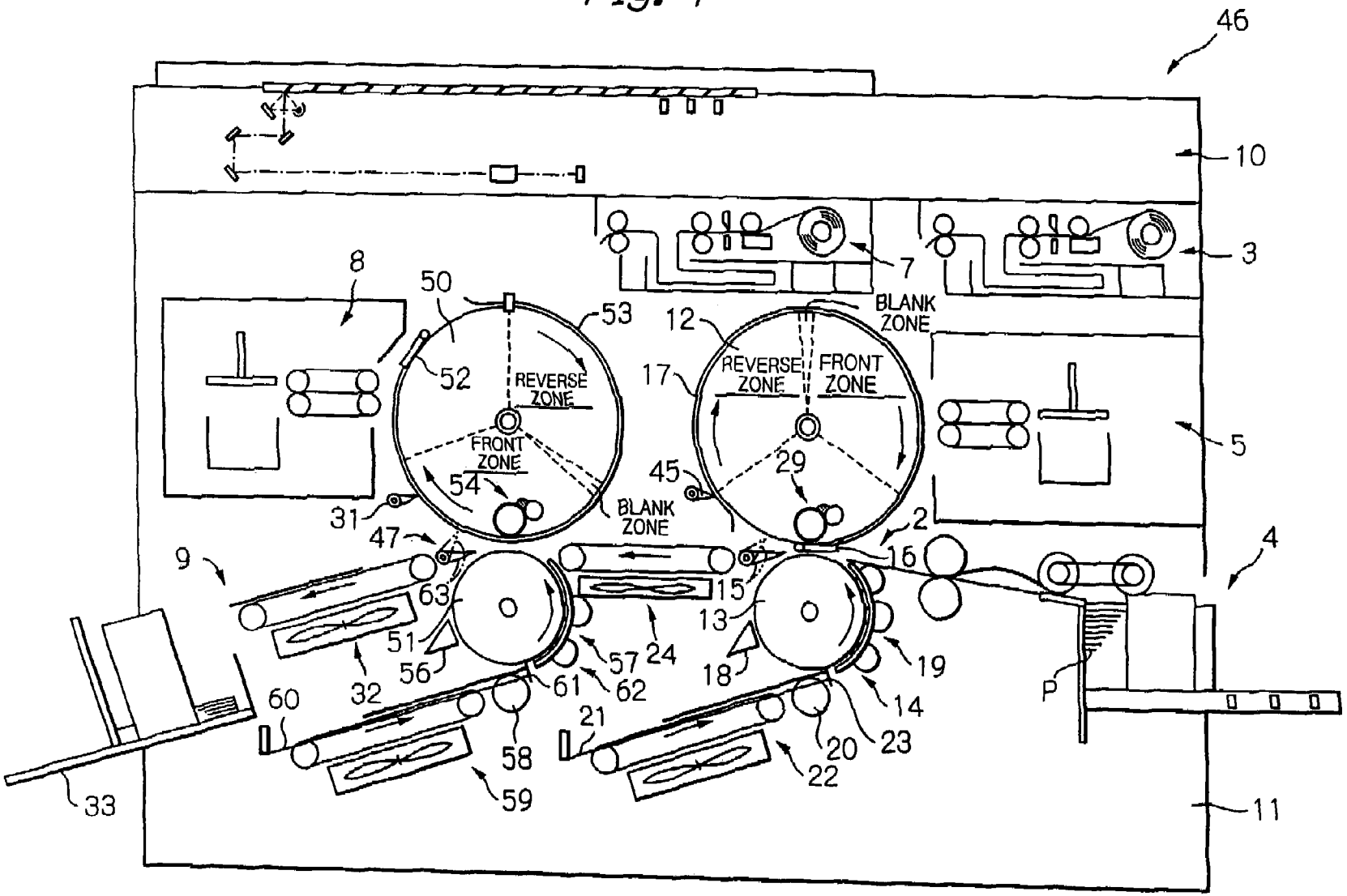
FIG. 4 is a front view showing an alternative embodiment of the stencil printer in accordance with the present invention.

Reference will be made to FIG. 4 for describing an alternative embodiment of the multiple-drum type stencil printer in accordance with the present invention. The alternative embodiment is essentially similar to the previous embodiment except that the printing section 6 is replaced with a single-flow duplex printing section 47 and that the control panel 36 and control means 44 are respectively replaced with a control panel 48 and control means 49, see FIGS. 5 and 6, respectively; identical structural parts and elements will not be described specifically in order to avoid redundancy.

As shown in FIG. 4, in the stencil printer generally designated by the reference numeral 46, the single-flow duplex printing section 47 is arranged at the left-hand side of the single-flow duplex printing section 2 and includes a print drum 50 and a press roller or pressing member 51. The print drum 50 is rotatably, removably mounted on the printer body 11 and caused to rotate by the previously mentioned drum drive means via the drive transmitting means, not shown, in synchronism with the print drum 12. A clamper 52 is hinged to the outer circumference of the print drum 50 in such a manner as to be operable away from the print drum 50. A dual master 53 is wrapped round the print drum 50 such that a first and a second image performed therein are positioned on a front zone and a reverse zone, respectively, formed on the print drum 50 while a blank portion, intervening between the front and reverse zones, is positioned on a blank zone also formed on the print drum 50, as shown in FIG. 4. A rotary encoder, not shown, is positioned in the vicinity of the outer circumference of the print drum 50 for sensing the angular position of the print drum 50.

Ink feeding means 54 similar in configuration to the ink feeding means 29 is disposed in the print drum 50 and removable from the printer body 11 integrally with the print drum 50. An ink pack, not shown, included in the ink feeding means 54, stores ink different in color from the ink stored in the ink pack of the ink feeding means 29. In the illustrative embodiment, too, the ink pack of the ink feeding means 29 and the ink pack of the ink feeding means 54 are assumed to store black ink and red ink, respectively, by way of example.

The press roller 51, identical in configuration with the press roller 13, is positioned below the print drum 50 and rotably supported at opposite ends thereof by a pair of arm members, not shown, which are, in turn, angularly movably supported by moving means 55, see FIG. 6. In this configuration, the press roller 51 is movable between a released position where it is released from the print drum 50, as shown in FIG. 4, and a contact position where it is pressed against the dual master 53 wrapped round the print drum 50. A guide member 56 adjoins the press roller 51 for guiding the sheet or print P toward an auxiliary tray 60.

Press roller drive means, not shown, identical in configuration with the press roller drive means 139 taught in Japanese patent laid-open publication No. 2003-200645 mentioned earlier, is located in the vicinity of the press roller 51 and causes the press roller 51 to rotate at the same peripheral speed as the print drum 50. A one-way clutch, not shown, is mounted on the press roller drive means in order to cause the press roller 51 to follow the rotation of the print drum 50 when pressed against the print drum 50.

The moving means 55 for angularly moving the arm members, not shown, includes three cam plates like a press roller moving mechanism 55 also taught in the above laid-open publication No. 2003-200645. The three cam plates are selectively brought into contact with a cam follower mounted on the arm members in order to cause press the press roller 51 against the print drum 50 over a first range corresponding to the first image or front zone, a second range corresponding to the second image or reverse zone or a third range covering both of the first and second images or front and reverse zones. In this sense, the moving means 55 plays the role of switching means for switching the range over which the press roller 51 is to be pressed against the print drum 50. Press roller holding means, not shown, is located in the vicinity of the moving means 55 for holding the press roller 13 at the released position.

A refeed guide member 57 identical with the refeed guide member 19 is positioned at the right-hand side of the press roller 51 while a refeed registration roller 58 identical with the refeed registration roller 20 is positioned below the press roller 51. Refeed conveying means 59 identical with the refeed conveying means 22 is located at the lower left of the press roller 51 and has an auxiliary tray 60 and a refeed positioning member 61 constructed integrally therewith. The refeed guide member 57, refeed registration roller 58, auxiliary tray 60, refeed conveying means 59 and refeed positioning member 61 constitute refeeding device or refeeding means 62 in combination.

A path selector 63 is positioned on the sheet path at the left-hand side of the position where the print drum 50 and press roller 51 are expected to contact each other. The path selector 63, like the path selector 15, is supported by moving means, not shown, in such a manner as to be movable between a first position and a second position indicated by a dash-and-dots line and a solid line, respectively, in FIG. 4. The path selector 63 guides the sheet P passed through the nip between the print drum 50 and the press roller 51 toward the auxiliary tray 60 when held in the first position or guides it toward the sheet discharging section 9 when held in the second position.

Figure 5:
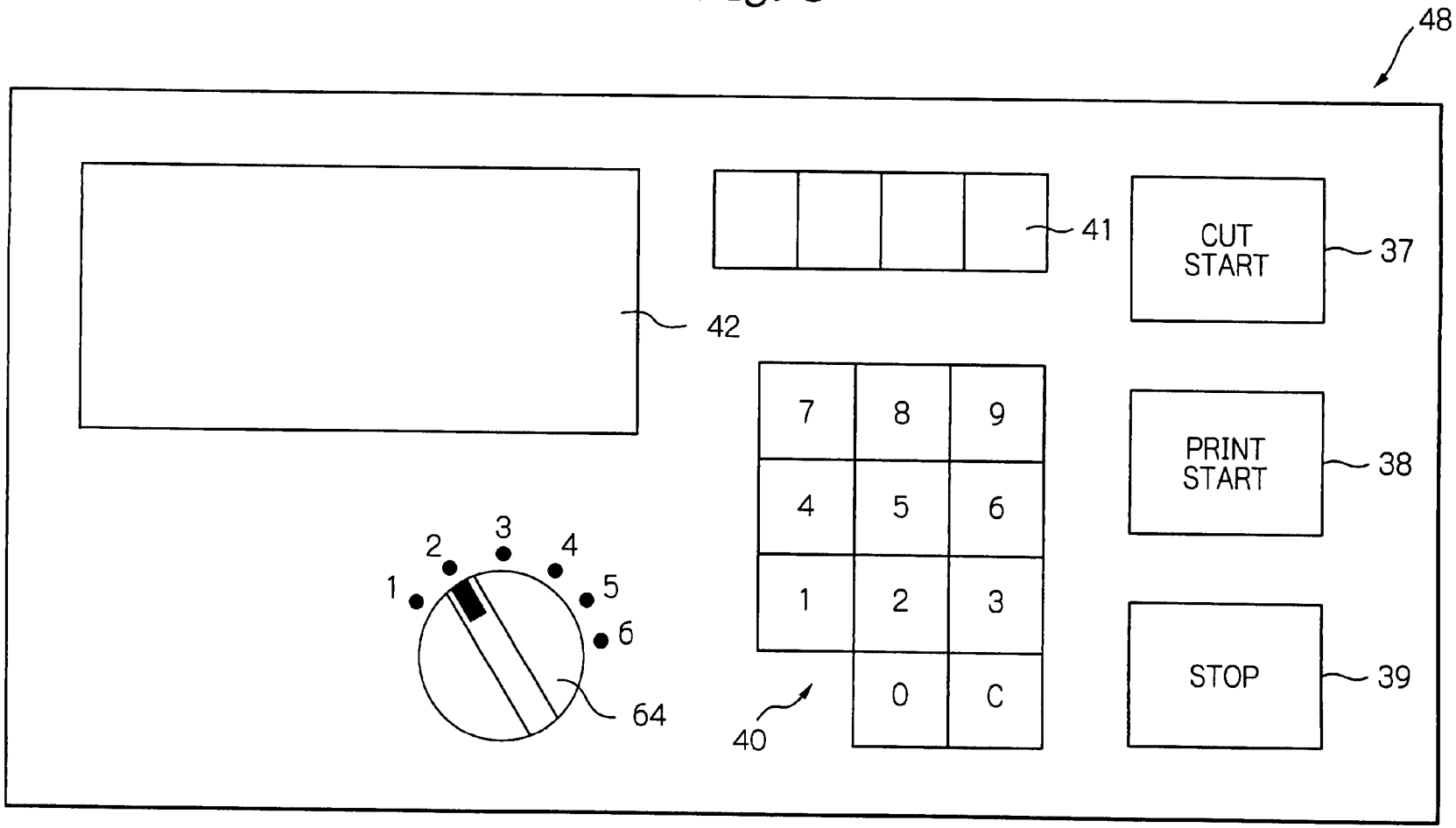
FIG. 5 shows a specific configuration of a control panel mounted on the stencil printer of FIG. 4.

FIG. 5 shows a specific configuration of a control panel 48 mounted on the top front portion of the printer body 11. As shown, the control panel 48 is identical with the control panel 36 of the previous embodiment except that a select switch 64 is substituted for the select switch 43. Identical structural parts and elements are will not be described in order to avoid redundancy.

In the illustrative embodiment, the select switch 64 allows the operator of the stencil printer 46 to select a sixth mode or duplex multicolor print mode for producing a duplex multicolor print in addition to the first or simplex monochrome print mode, second or simplex multicolor print mode, third or duplex monochrome print mode, fourth or duplex different-color print mode and fifth or one-surface monochrome, the other surface multicolor print mode available with the previous embodiment.

Figure 6:
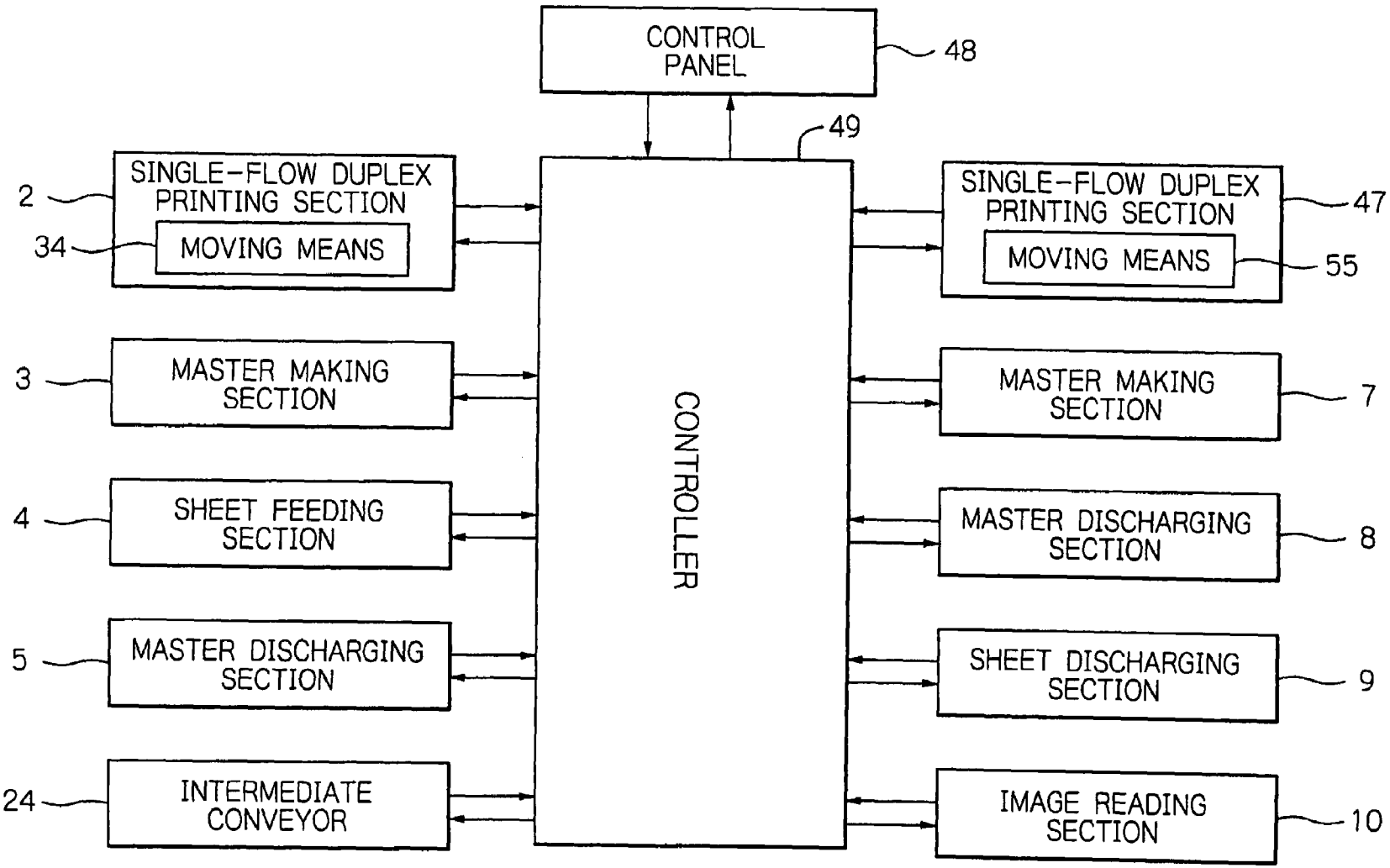
FIG. 6 is a schematic block diagram showing a control system included in the alternative embodiment.

FIG. 6 shows a control system included in the illustrative embodiment and includes a controller or control means 44 implemented by a microcomputer like the controller 44 ofthe previous embodiment. The controller 49 controls the single-flow duplex printing section 2, master making section 3, sheet feeding section 4, master discharging section 5, single-flow duplex printing section 47, master making section 7, master discharging section 8, sheet discharging section 9, image reading section 10 and intermediate conveyor 24 in accordance with the output signals of the rotary encoder and control panel 48 as well as signals output from various sensors not shown.

The operation of the multiple-drum type stencil printer 46 will be described hereinafter. Let the following description concentrate on the sixth mode selectable with the select switch 64 because the first to fifth modes are executed in exactly the same manner as in the previous embodiment.

Assume that the operator selects the sixth mode unique to the illustrative embodiment by setting the select switch 64 at the position of "6" on the control panel 48, lays first one of desired four documents on the glass platen of the image reading section 10 and then pushes the cut start switch 37. Then, the image reading section 10 reads the image of the first document while the master discharging section 5 peels off a used master 17 from the print drum 12. After the image reading section 10 has fully read the first document, the operator lays a second document on the glass platen and again pushes the cut start key 37. In response, the image reading section 10 reads the image of the second document.

Subsequently, the operator lays a third document on the glass platen and again pushes the cut start key 37, the image reading section 10 reads the image of the third document while the master discharging section 8 peels off a used master 53 from the print drum 50. After the document reading section 10 has read the entire third document, the operator sets a fourth or last document on the glass platen and again pushes the cut start key 37. In response, the image reading section 10 reads the image of the fourth document, and then the master making sections 3 and 7 are operated to produce new dual masters 17 and 53, respectively, and cause the masters 17 and 53 to be wrapped round the print drums 12 and 50, respectively.

In the duplex multicolor print mode, the dual master 17 is formed with a first image corresponding to the first document image and expected to be printed on one or front surface of a sheet P in a first color and a second image corresponding to the second document image and expected to be printed on the other or reverse surface of the above sheet P in the first color. On the other hand, the dual master 53 is formed with a first image corresponding to the fourth document image and expected to be printed on the reverse surface of the above sheet P in a second color and a second image corresponding the third document image and expected to be printed on the front surface of the same sheet P in the second color.

In the above configuration, the sheet or duplex print P output from the single-flow duplex printing section 2 is positioned upside down when brought to the next single-flow duplex printing section 47 by the intermediate conveyor 24, compared to the position stacked in the sheet feeding section 4, so that an image is printed on the reverse surface of the sheet P first and then on the front surface of the same by the printing section 47. Consequently, assuming that only odd single-flow duplex printing sections are counted from the upstream side in the direction of sheet conveyance, then the odd duplex printing section 47 prints the first and second images of the dual master 53 wrapped round the print drum 50 on the reverse surface and front surface of the sheet P, respectively. For this reason, the first and second images of the dual master 53 are opposite in position to the first and second images of the dual master 17.

More specifically, although the operator should preferably rearrange the order of documents before the documents are read by the image reading section 10, such rearrangement is not only awkward to perform, but also apt to bring about errors. In light of this, the master making section 7 forms the image of a third document and the image of a fourth document read in this order as a second image and a first image, respectively. Therefore, the operator should only sequentially set documents on the glass platen in the usual order such that the image reading section 10 reads a document, corresponding to the first-color image to be printed on the one surface of the sheet P, as a first document, reads a document, corresponding to the first color image to be printed on the other surface of the sheet P, as a second document, reads a document, corresponding to the second-color image to be printed on the one surface of the sheet P, as a third document, and reads a document, corresponding to the second-color image to be printed on the other surface of the sheet P, as a fourth document.

After the stencil printer 46 has been brought into a stand-by condition with the dual masters 17 and 53 being wrapped round the print drums 12 and 50, respectively, the operator inputs desired printing conditions on the control panel 48 and then pushes the print start key 38. In response, the print drums 12 and 50 are caused to rotate at a peripheral speed corresponding to a desired print speed while a single sheet P is fed from the sheet feeding section 4 toward the registration roller pair. The registration roller pair stops the sheet P to correct skew thereof and then drives it toward the gap between the print drum 12 and the press roller 13 at preselected timing.

The moving means 34 causes the press roller 13 to remain in contact with the print drum 12 over the first range. When the print drum 12 is rotated to a preselected angular position where its front zone faces the press roller 13, the moving means 34 brings the press roller 13 to the contact position to thereby press the sheet P against the first image formed in the dual master 17. Consequently, an image, corresponding to the image of the first document, is printed in black on one or front surface of the sheet P. The sheet or simplex print P, carrying the above image on the front surface, is peeled off from the print drum 12 by the edge of the path selector 15, which is held in the first position then, and guided to the auxiliary tray 21 thereby. The sheet P on the auxiliary tray 21 is conveyed by the refeed conveying means 22 in a direction indicated by an arrow in FIG. 4 until the leading edge of the sheet P has been stopped by the refeed positioning member 23.

The print drum 12 is continuously rotated even when the first sheet P is being guided to the auxiliary tray 21, while a second sheet P is fed from the sheet feeding section 4 at the same timing as the first sheet P. The second sheet P, like the first sheet P, is pressed by the press roller 13 to be formed with a black image on one surface thereof, then peeled off from the print drum 12 by the peeler 15 held in the first position, and then guided to the auxiliary tray 21. At this time, the moving means 34 is so set as to press the press roller 13 against the print drum 12 over the third range.

After the second sheet P has been fed from the sheet feeding section 4, but slightly before the time when the reverse zone of the print drum 12 comes to face the press roller 13, the refeed registration roller 20 is driven to press the first sheet P held on the auxiliary tray 21 against the press roller 13. As a result, the first sheet P is conveyed by the press roller 13, which is being driven by the print drum 12 in contact therewith, to the nip between the press roller 13 and the print drum 12 and pressed against the second image formed in the dual master 17, so that a black image, corresponding to the image of the second document, is transferred to the other surface of the sheet P.

The first sheet or duplex print P, carrying the black images on both surfaces thereof, is peeled off from the print drum 12 by the path selector 15 held in the second position then and the peeler 45 caused to adjoin the print drum 12 and delivered to the intermediate conveyor 24. The first sheet P is then conveyed further downward by the intermediate conveyor 24 to the gap between the print drum 50 and the press roller 52 at preselected timing. At this instant, the moving means 55 is so set as to press the press roller 51 against the print drum 50 over the first range beforehand. When the print drum 50 is rotated to a preselected angular position where its front zone faces the press roller 51, the moving means 55 moves the press roller 51 to the contact position in order to press the first sheet P against the first image of the dual master 53 wrapped round the print drum 50. Consequently, an image, corresponding to the image of the fourth document, is printed in red on the other surface of the first sheet P. The first sheet P is then peeled off from the print drum 50 by the path selector 63 held in the first position then and conveyed to the auxiliary tray 60 until its leading edge has been stopped by the refeed positioning member 61.

The print drum 50 is continuously rotated even when the first sheet P is being guided to the auxiliary tray 60, while a second sheet P is fed from the sheet feeding section 4 at the same timing as the first sheet P. The second sheet P, like the first sheet P, is pressed by the press roller 13 to be formed with a red image on one surface thereof, then peeled off from the print drum 50 by the peeler 63 held in the first position then, and then guided to the auxiliary tray 60. At this time, the moving means 55 is so set as to press the press roller 51 against the print drum 50 over the third range beforehand.

After the second sheet P has been fed from the sheet feeding section 4, but slightly before the time when the reverse zone of the print drum 50 comes to face the press roller 51, the refeed registration roller 58 is driven to press the first sheet P held on the auxiliary tray 60 against the press roller 51. As a result, the first sheet P is conveyed by the press roller 51, which is being driven by the print drum 50 in contact therewith, to the nip between the press roller 13 and the print drum 12 and pressed against the second image formed in the dual master 53, so that a red image, corresponding to the image of the third document, is transferred to the one surface of the sheet P.

After the transfer of the red image identical with the image of the third document, the first sheet or duplex multicolor print P is peeled off from the print drum 50 by the path selector 63 held in the second position then and peeler 31 brought close to the print drum 50 and is then delivered to the sheet conveying means 32 and then conveyed by the sheet conveying means 32 to the print tray 33. The procedure described above is repeated until a desired number of duplex multicolor prints have been output. It is to be noted that after the last sheet P has been stopped on the auxiliary tray 21, the moving means 34 causes the press roller 13 to contact the print drum 12 over the second range.

As stated above, the stencil printer 46 is capable of executing single-flow duplex multicolor printing in the sixth or duplex multicolor print mode in addition to the first to fifth print modes stated previously. In the illustrative embodiment, a single single-flow duplex printing section 47 is located downstream of the single-flow duplex printing section 2 in order to implement duplex bicolor printing. Alternatively, a plurality of printing sections identical with the printing section 6 may be arranged between the single-flow duplex printing sections 2 and 47 or downstream of the duplex printing section 47 in order to implement duplex printing in three or more different colors, in which case intermediate conveyors identical with the intermediate conveyor 24 are located between nearby printing sections. Such additional printing sections are controlled in the same manner as the printing section 6 of the first embodiment.

In summary, it will be seen that the present invention provides a multiple-drum type stencil printer operable in any one of a first or one-surface monochrome print mode, a second or one-surface multicolor print mode, a third or duplex monochrome print mode, a fourth or duplex different-color print mode, a fifth or one-surface monochrome, the other surface multicolor print mode, thereby implementing single-flow duplex multicolor printing.

Various modifications will become possible for those skilled in the art after receiving the teachings of the present disclosure without departing from the scope thereof.

What is claimed is:

1. A multi-drum stencil printer, comprising:

a plurality of printing sections each including a respective print drum and a respective pressing means configured to press a sheet against said print drum;

intermediate conveying means positioned between an upstream printing section of the plurality of printing sections and a downstream printing section of the plurality of printing sections, the intermediate conveying means configured to convey the sheet from the upstream printing section toward the downstream printing section in a direction of sheet conveyance;

a dual master formed with a first image and a second image configured to be wrapped around a circumferential surface of the print drum in a most upstream one of the plurality of printing sections located at a most upstream position in the direction of sheet conveyance; and controlling means configured to control the multi-drum stencil printer in response to a selected print mode, wherein the pressing means in said most upstream one of the plurality of printing sections is rotated by drive means, said most upstream one of the plurality of printing sections and at least one downstream one of the plurality of printing sections, located downstream of said most upstream one of the plurality of printing sections in the direction of sheet conveyance, includes a single-flow duplex printing section including refeeding means for storing a sheet, the sheet carrying an image on one surface thereof, and then refeeding said sheet toward a gap between said respective print drum and said respective pressing means, a path selector selectively movable to a first position for guiding the sheet toward said refeeding means or a second position for guiding said sheet toward said intermediate conveying means, and switching means for causing said pressing means to remain in contact with said print drum over any one of a first range corresponding to the first image, a second range corresponding to the second image and a third range covering both of said first image and said second image, and when a print mode is selected to produce a print carrying multicolor images on both surfaces thereof, the controlling means controls a positioning of the dual masters such that the dual master wrapped around said print drum of one of the single-flow duplex printing sections has the first image and the second image in opposite positions to the first image and the second image of the dual master used in an adjacent one of the single-flow duplex printing sections.

2. The stencil printer as claimed in claim 1, wherein said plurality of printing sections store ink of a same color or ink of different colors for thereby selectively implementing a first print mode for producing a print carrying a monochromatic image on one surface thereof, a second print mode for producing a print carrying a multicolor image on one surface thereof, a third print mode for producing a print carrying images of a same color on opposite surfaces thereof, a fourth print mode for producing a print carrying images of different colors on opposite surfaces thereof, a fifth print mode for producing a print carrying a monochromatic image on one surface thereof and carrying a multicolor image on the other surface thereof, or a sixth print mode for producing a print carrying multicolor images on opposite surfaces thereof.

3. The stencil printer as claimed in claim 1, wherein each of the plurality of printings sections includes a single-flow duplex printing section.

4. The stencil printer as claimed in claim 1, further comprising:

registration means configured to correct a skew of the sheet.

5. A multi-drum stencil printer, comprising:

a plurality of printing sections each including a respective print drum and a respective press roller configured to press a sheet against said print drum;

an intermediate conveyor positioned between an upstream printing section of said plurality of printing sections and a downstream printing section of the plurality of printing sections to convey the sheet from the upstream printing section toward the downstream printing section in a direction of sheet conveyance;

a dual master formed with a first image and a second image configured to be wrapped around a circumferential surface of the print drum in a most upstream one of the plurality of printing sections located at a most upstream position in the direction of sheet conveyance; and a controller configured to control the multi-drum stencil printer in response to a selected print mode, wherein the press roller in said most upstream one of the plurality of printing sections is rotated by a drive source, said most upstream one of the plurality of printing sections and at least one downstream one of the plurality of printing sections, located downstream of said most upstream one of the plurality of printing sections in the direction of sheet conveyance, includes a single-flow duplex printing section including a refeeding device for storing a sheet, the sheet carrying an image on one surface thereof, and then refeeding said sheet toward a gap between said respective print drum and said respective press roller, a path selector selectively movable to a first position for guiding the sheet toward said refeeding device or a second position for guiding said sheet toward said intermediate conveyor, and a switching device for causing said press roller to remain in contact with said print drum over any one of a first range corresponding to the first image, a second range corresponding to the second image and a third range covering both of said first image and said second image, and when a print mode is selected to produce a print carrying multicolor images on both surfaces thereof, the controller controls a positioning of the dual masters such that the dual master wrapped around said print drum of one of the single-flow duplex printing sections has the first image and the second image in opposite positions to the first image and the second image of the dual master used in an adjacent one of the single-flow duplex printing sections.

6. The stencil printer as claimed in claim 5, wherein said plurality of printing sections store ink of a same color or ink of different colors for thereby selectively implementing a first print mode for producing a print carrying a monochromatic image on one surface thereof, a second print mode for producing a print carrying a multicolor image on one surface thereof, a third print mode for producing a print carrying images of a same color on opposite surfaces thereof, a fourth print mode for producing a print carrying images of different colors on opposite surfaces thereof, a fifth print mode for producing a print carrying a monochromatic image on one surface thereof and carrying a multicolor image on the other surface thereof, or a sixth print mode for producing a print carrying multicolor images on opposite surfaces thereof.

7. The stencil printer as claimed in claim 5, wherein each of the plurality of printings sections includes a single-flow duplex printing section.

8. The stencil printer as claimed in claim 5, further comprising:

a registration roller configured to correct a skew of the sheet.

9. A multi-drum stencil printer, comprising:

a plurality of printing sections, wherein each of the plurality of printing sections includes a print drum and a press roller configured to press a sheet against the print drum;

at least one intermediate conveyor configured to convey the sheet from an upstream printing section toward a downstream printing section in a direction of sheet conveyance;

a first single-flow duplex printing section including a first refeeding device, located at a most upstream position in the direction of sheet conveyance, the first single-flow duplex printing section is configured to store a sheet carrying an image on one surface thereof and then refeed the sheet toward a gap between a first print drum and a first press roller in the first single-flow duplex printing section;

a first path selector, included in the first single-flow duplex printing section, configured to be selectively movable to a first position for guiding the sheet toward the first refeeding device or a second position for guiding the sheet toward a first intermediate conveyor located in a downstream direction from the first single-flow duplex printing section;

a first switching device, included in the first single-flow duplex printing section, configured to cause the first press roller to remain in contact with the first print drum over any one of a first range corresponding to a first image, a second range corresponding to a second image and a third range covering both of the first image and the second image;

a second printing section, located next to the first printing section in the direction of sheet conveyance, including a second single-flow duplex printing section configured to store the sheet and then refeed the sheet toward a gap between a second print drum and a second press roller included in the second printing section and conflaured to receive a second dual master formed with the third image and the fourth image around a circumferential surface of the second print drum; and a controller configured to control the multi-drum stencil printer in response to a selected print mode, wherein the first single-flow duplex printing section includes the first print drum configured to receive a first dual master formed with a first image and a second image around a circumferential surface of the upper most print drum, and when a print mode is selected to produce a print carrying multicolor images on both surfaces thereof, the controller controls a positioning of the dual masters such that the dual master wrapped around the first print drum has the first image and the second image in opposite positions to the third image and the fourth image of the dual master wrapped around the second print drum.

10. The multi-drum stencil printer according to claim 9, wherein the second printing section includes a second path selector configured to be selectively movable to a first position for guiding the sheet toward a second refeeding device or a second position for guiding the sheet toward a second intermediate conveyor located in the downstream direction from the second printing section.

11. The multi-drum stencil printer according to claim 10, wherein the second printing section includes a second switching device configured to cause the second press roller to remain in contact with the second print drum over any one of a fourth range corresponding to a third image, a fifth range corresponding to a fourth image and a sixth range covering both of the third image and the fourth image.

12. The multi-drum stencil printer according to claim 11, wherein the first printing section stores ink of a first color, the second printing section stores ink of a second color, and the first color is different from the second color.

13. The multi-drum stencil printer according to claim 12, wherein the plurality of printing sections store ink of a same color or ink of different colors for thereby selectively implementing a first print mode for producing a print carrying a monochromatic image on one surface thereof, a second print mode for producing a print carrying a multi-color image on one surface thereof, a third print mode for producing a print carrying images of a same color on opposite surfaces thereof, a fourth print mode for producing a print carrying images of different colors on opposite surfaces thereof, a fifth print mode for producing a print carrying a monochromatic image on one surface thereof and carrying a multicolor image on the other surface thereof, or a sixth print mode for producing a print carrying multicolor images on opposite surfaces thereof.

14. The stencil printer as claimed in claim 9, wherein each of the plurality of printings sections includes a single-flow duplex printing section.

15. The stencil printer as claimed in claim 9, further comprising:

a registration roller configured to correct a skew of the sheet.

* * * * *

UNITED STATES PATENT AND TRADEMARK OFFICE

CERTIFICATE OF CORRECTION

PATENT NO. : 7,331,284 B2
APPLICATION NO. : 11/362815
DATED : February 19, 2008
INVENTOR(S) : Mituru Takahashi It is certified that error appears in the above-identified patent and that said Letters Patent is hereby corrected as shown below:

Column 16, line 54, change “44” to --49--.

Signed and Sealed this

Ninth Day of September, 2008

JON W. DUDAS
*Director of the United States Patent and Trademark Office*